US005119054A

United States Patent [19]

Grunert et al.

[11] Patent Number: 5,119,054

[45] Date of Patent: Jun. 2, 1992

[54] "E" FRAME PANCAKE DESIGN

[75] Inventors: Kurt A. Grunert, Beaver; John A. Wafer, Brighton Township, Beaver County; Henry A. Wehrli, III, Monroeville, all of Pa.; Lawrence M. Hapeman, Fletcher, N.C.

[73] Assignee: Westinghouse Elecric Corp., Pittsburgh, Pa.

[21] Appl. No.: 574,978

[22] Filed: Aug. 30, 1990

[51] Int. Cl.[5] ..... H01H 77/02

[52] U.S. Cl. ..... 335/35; 335/21

[58] Field of Search ..... 335/8-10, 335/21, 22, 23, 35, 38-42, 167-174

[56] References Cited

U.S. PATENT DOCUMENTS

| | | | |
|---|---|---|---|
| 1,772,442 | 8/1930 | Hanny | 335/35 |
| 2,942,079 | 5/1958 | Dorfman | 335/38 |
| 3,421,123 | 1/1969 | Johnson et al. | 335/38 |
| 3,797,007 | 3/1974 | Salvati et al. . | |
| 4,489,295 | 12/1984 | Altenhof, Jr. et al. . | |
| 4,638,277 | 1/1987 | Thomas et al. . | |
| 4,656,444 | 4/1987 | McKee et al. . | |
| 4,679,018 | 7/1987 | McKee et al. . | |
| 4,691,182 | 9/1987 | Mrenna et al. . | |
| 4,698,606 | 10/1987 | Mrenna et al. . | |
| 4,713,635 | 12/1987 | Flick et al. | 335/9 |
| 4,725,800 | 2/1988 | Grunert et al. . | |

*Primary Examiner*—Harold Broome
*Assistant Examiner*—Lincoln Donovan
*Attorney, Agent, or Firm*—M. J. Moran

[57] ABSTRACT

A molded case circuit breaker is provided with a magnetic trip unit which includes an armature assembly and a multi-turn magnetic coil assembly. The magnetic coil assembly is formed to occupy substantially the same volume as a single-turn magnetic coil. The added turns in the magnetic coil increase the attraction force on the armature to essentially lower the electric current value at which the magnetic unit trips the circuit breaker. By utilizing a multi-turn magnetic coil assembly which occupies the same space as the single-turn magnetic coil, the same frame size can be used for both single-turn magnetic coils, and multi-turn magnetic coils without the need to locate the thermal unit outside of the molded case circuit breaker.

20 Claims, 2 Drawing Sheets

"E" FRAME PANCAKE DESIGN

CROSS-REFERENCE TO RELATED APPLICATIONS

The invention disclosed herein relates to molded case circuit breakers. The following patent applications all relate to molded case circuit breakers and were filed on Aug. 1, 1988: Ser. No. 226,503, entitled CROSS-BAR ASSEMBLY, by Jere L. McKee, Lance Gula and Glenn R. Thomas; and Ser. No. 226,655, entitled COMBINATION BARRIER AND AUXILIARY CT BOARD, by Gregg Nissly, Allen B. Shimp and Lance Gula.

The following commonly assigned U.S. patent applications were filed on Oct. 12, 1988 and all relate to molded case circuit breakers: Ser. No. 256,881, entitled SCREW ADJUSTABLE CLINCH JOINT WITH BOSSES, by J ames N. Altenhof, Ronald W. Crookston, Walter V. Bratkowski, and J. Warren Barkell; Ser. No. 256,879 entitled TAPERED STATIONARY CONTACT LINE COPPER, by Ronald W. Crookston, and Ser. No. 256,878, entitled TWO-PIECE CRADLE LATCH FOR CIRCUIT BREAKER, by Alfred E. Maier and William G. Eberts.

The following commonly assigned U.S. patent applications also relate to molded case circuit breakers: Ser. No. 260,848, filed on Oct. 21, 1988, entitled UNRIVETED UPPER LINK SECUREMENT, by Joseph Changle and Lance Gula; Ser. No. 07/331,769, filed on Apr. 3, 1989, entitled ARC RUNNER CONTAINMENT SUPPORT ASSEMBLY, by Charles Paton, Kurt Grunert and Glen Sisson; and Ser. No. 07/331,920, filed on Mar. 31, 1989, entitled EXTENDER SPRING FOR INCREASED MAGNETIC TRIP SETTINGS, by Kurt Grunert.

The following two commonly owned patent applications were filed on Apr. 25, 1989: Ser. No. 07/343,047, entitled TWO-PIECE CRADLE LATCH, KEY BLOCKS AND SLOT MOTOR FOR CIRCUIT BREAKER, by Alfred E. Maier, William G. Eberts and Richard E. White and Ser. No. 07/342,820, entitled TWO-PIECE CRADLE LATCH, HANDLE BARRIER LOCKING INSERT AND COVER INTERLOCK FOR CIRCUIT BREAKER, by A. D. Carothers, D. A. Parks, R. E. White and W. G. Eberts.

Commonly owned patent application Ser. No. 07/374,370 was filed on Jun. 30, 1989, entitled REVERSE SWITCHING MEANS FOR MOTOR OPERATOR, by Kurt Grunert and Charles Paton.

Commonly owned patent application Ser. No. 07/389,849 was filed on Aug. 14, 1989, entitled TRIP INTERLOCK DESIGN, by Kurt Grunert, Ronald Cheski, Robert Tedesco, Michael J. Whipple, Melvin A. Carrodus and James G. Maloney.

Lastly, this application is also related to commonly owned patent application Ser. No. 07/491,329, filed on Mar. 9, 1990, entitled PINNED SHUNT END EXPANSION JOINT, by Lance Gula and Roger Helms.

BACKGROUND OF THE INVENTION

1. Field of the Invention

This invention relates to molded case circuit breakers and more particularly to molded case circuit breakers having a magnetic trip unit including an armature and a magnetic coil having a plurality of turns that occupies the same volume as a single turn magnetic coil.

2. Description of the Prior Art

Molded case circuit breakers are generally old and well-known in the art. Examples of such circuit breakers are disclosed in U.S. Pat. Nos. 4,489,295; 4,638,277; 4,656,444 and 4,679,018. Such circuit breakers are generally used to protect electrical circuitry from damage due to an overcurrent condition, such as an overload and a relatively high level short circuit condition. An overload condition is normally 200 to 300 percent of the nominal current rating of the circuit breaker. A high level short circuit condition can be 1000 percent or more of the nominal current rating of the circuit breaker.

Molded case circuit breakers generally include at least one pair of separable main contacts which may be operated manually by way of an operating handle, extending outwardly from the circuit breaker case, or automatically in response to an overload or a high level short circuit condition. In the manual mode and one automatic mode of operation, the separable main contacts are opened by an operating mechanism which, in turn, is actuated by either a trip unit in the automatic mode or the operating handle in the manual mode. In another automatic mode of operation, magnetic repulsion forces, generated between the stationary and movable main contacts during relatively high level overcurrent conditions, can also cause the main contacts to be separated independently of the operating mechanism.

In the first mentioned automatic mode of operation, trip units, which may be combination thermal magnetic trip units or magnetic only trip units are used to sense an overcurrent condition. These trip units are interlocked with the circuit breaker operating mechanism to cause the separable main contacts to be tripped during an overcurrent condition.

Various types of trip units are known. In one type, the trip unit is formed as a part of the circuit breaker. In another type, the trip unit is interchangeable and is formed as a modular unit with a separate housing which can easily be inserted and removed from the circuit breaker as a unit.

Depending upon the type of electrical load to be protected, some trip units are provided with magnetic only trip units, such as in the case of electric arc welders. In other applications, a magnetic only trip unit is provided on the circuit breaker when the overload protection is provided in another device, such as a motor contactor, generally provided with its own overload relays. However, for many electrical loads, such as electrical motors, both overload and short circuit protection is required by the circuit breaker Accordingly, combination thermal magnetic trip units, which may be adjustable, are provided on circuit breakers supplying such electrical loads. Examples of such adjustable thermal magnetic tripping units are disclosed in U.S. Pat. Nos. 4,691,182; 4,698,606 and 4,725,800, all assigned to the same assignee as the present invention and hereby incorporated by reference.

The combination thermal magnetic trip units are comprised of a thermal unit and a magnetic unit. The thermal unit consists of one or more bimetals which cause the circuit breaker to be tripped during an overload condition. The bimetals are generally disposed in series with a line conductor and thus are subjected to line current. During normal operating conditions, the bimetals are deflected by the line current flowing therethrough but not enough to cause a trip of the circuit breaker. During an overload condition, the bimetals are subjected to additional heat resulting from the increased current flow therethrough which causes additional deflection of the bimetals resulting in tripping of the circuit breaker The magnetic unit includes a magnetic coil assembly and a pivotally mounted armature. The pivotally mounted armature is generally interlocked to trip the circuit breaker during relatively high level overcurrent conditions, such as a short circuit condition. Due to space restrictions in smaller frame size molded case circuit breakers, a single turn magnetic coil, commonly formed from a generally U-shaped conductor, is disposed in series with the line conductor and disposed about a magnetic core forming a magnetic coil assembly. The pivotally mounted armature is disposed at a predetermined air gap from the magnetic coil assembly. When the electrical current through the U-shaped conductor becomes relatively high, such as during a short circuit condition, sufficient magnetic attraction forces are generated in the magnetic coil assembly to attract the armature. Since the armature is interlocked with the operating mechanism, this action causes the circuit breaker to be tripped.

The tripping force of the magnetic trip unit is generally a function of the product of the electrical current therethrough and the number of turns provided in the magnetic coil assembly. The magnetic tripping force is generally set to trip at 15 times the continuous electrical current rating of the circuit breaker Thus, for a 150 amp frame circuit breaker, normally used in applications where the desired continuous electrical current of the circuit breaker is between 15 amperes and 150 amperes, the magnetic tripping force would thus be set to trip at between, for example, 225 amperes or 2,250 amperes, respectively, such as in a Westinghouse type HFD molded case circuit breaker.

In such molded case circuit breakers, since a single turn magnetic coil is generally provided due to space limitations, the tripping force thus becomes proportional to the electrical current through the single turn magnetic coil.

However, there are instances where it is desirable for the magnetic trip unit to trip the circuit breaker at magnitudes far less than 15 times the full load rating of the circuit breaker. For example, there are certain applications where it is desirable to trip at one-half of the normal value (e.g., 110 amperes for a 15 ampere circuit breaker).

There are several ways to adjust the trip rating of the magnetic trip unit. One way is to adjust the air gap between the armature and the magnetic coil assembly. Specifically, in order to lower the trip rating of the magnetic trip unit, it would be necessary to reduce the air gap between the armature and the magnetic coil. However, due to the environmental factors, especially vibrations, that many circuit breakers can be subjected to, it is undesirable to reduce the air gap since this may cause spurious trips of the circuit breaker.

Another way to reduce the electrical current at which the magnetic unit trips the circuit breaker, is to increase the tripping force of the armature assembly. The tripping force of the armature assembly may be increased by increasing the number of ampere turns in the magnetic coil. However, due to space constraints within many known molded case circuit breakers, increasing the ampere turns in the magnetic coil in the magnetic trip unit requires additional volume which generally requires a larger frame size to be used. However, using such a larger frame size for molded case circuit breakers having relatively lower magnetic trip ratings greatly increases the cost of such circuit breakers. Additionally, it frustrates the desire to standardize among molded case circuit breakers having various magnetic trip ratings.

In some known circuit breakers, such as in a Westinghouse type HMCP, additional windings are provided the magnetic coil. However, to accommodate the additional space requirements for such additional windings, the type HMCP is provided as a magnetic-only circuit breaker. In other words, such a circuit breaker is provided without a thermal unit to accommodate the additional space required for the additional windings in the magnetic unit. Thus, in such an application, if thermal protection is also required, it must be provided as a separate unit, such as a thermal overload relay. Such an application would result in substantially increased cost to the end user.

SUMMARY OF THE INVENTION

It is an object of the present invention to provide a magnetic trip unit for a molded case circuit breaker which solves the problems associated with the prior art.

It is another object of the present invention to provide a molded case circuit breaker having a magnetic trip unit which includes an armature assembly and a magnetic coil assembly having a multi-turn magnetic coil which occupies substantially the same volume as a single-turn magnetic coil.

It is yet another object of the present invention to provide a molded case circuit breaker having a magnetic trip unit with a multi-turn magnetic coil that does not require a relatively larger frame size than a circuit breaker with a magnetic trip unit having a single turn magnetic coil.

Briefly, the present invention relates to a molded case circuit breaker having a magnetic trip unit which includes an armature assembly and a magnetic coil assembly having a multi-turn magnetic coil. The magnetic coil assembly is formed to occupy substantially the same volume as a single-turn magnetic coil. The added turns in the magnetic coil increase the attraction force on the armature to essentially lower the electrical current value at which the magnetic unit trips the circuit breaker. By utilizing a multi-turn magnetic coil which occupies the same space as the single-turn magnetic coil, the same frame size can be used for both single-turn magnetic coils and multi-turn magnetic coils without the need to locate the thermal unit outside of the molded case circuit breaker.

DESCRIPTION OF THE DRAWING

These and other objects and advantages of the present invention will become readily apparent upon consideration of the following detailed description and attached drawing, wherein:

FIG. 8 is a partial perspective view of an alternate embodiment of the present invention.

DETAILED DESCRIPTION

Figure 1:
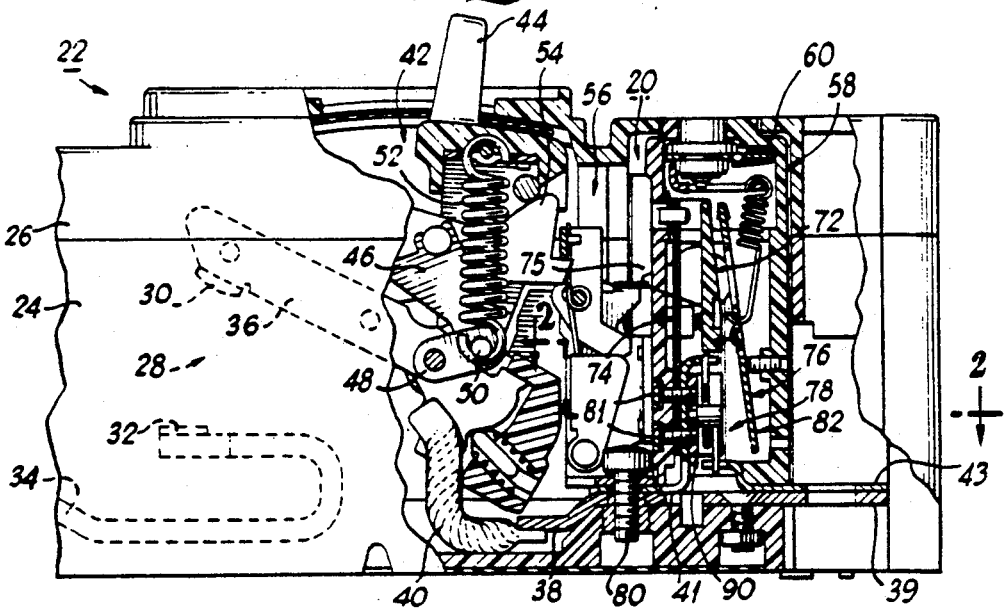
FIG. 1 is a side elevational view partially broken away of a molded case circuit breaker illustrating the present invention.

The magnetic trip unit in accordance with the present invention is generally identified with the reference numeral 20. It should be understood by those of ordinary skill in the art that the principles of the present invention are equally applicable to interchangeable type magnetic trip units as shown in FIGS. 1-7 and non-interchangeable type magnetic trip units as shown in FIG. 8. It should also be understood by those of ordinary skill in the art that the principles of the present invention are equally applicable to magnetic only trip units and combination thermal magnetic trip units having either adjustable or non-adjustable magnetic and/or thermal units. Lastly, it should be clear that the principles of the present invention apply equally to various multipole circuit breakers, such as two pole and three pole circuit breakers.

Referring to the drawings, a molded case circuit breaker 22 is illustrated having a base 24 and a coextensive cover 26. Disposed within the base 24 are one or more pairs of separable main contacts 28 which include an upper main contact 30 and a lower main contact 32 The lower main contact 32 is carried by a rigid lower main contact arm 34 and forms a portion of a line side conductor. The upper main contact 30 is carried by a pivotally mounted upper contact arm 36 and is serially connected to a load side conductor 38 by way of a flexible shunt 40.

The upper main contact arm 36 is mechanically interlocked with an operating mechanism 42 and an operating handle 44. The operating mechanism 42 is described in detail in U.S. Pat. No. 3,797,007, assigned to the same assignee as the assignee of the present invention and hereby incorporated by reference. Briefly, the operating mechanism 42 is an overcenter toggle mechanism which includes a pair of upper toggle links 46 and a pair of lower toggle links 48, pivotally connected together at a knee joint 50. An operating spring 52 is disposed between the knee joint 50 and the operating handle 44.

The operating handle 44 interacts with a cradle 54 and is latched by a latch assembly 56 during normal operation. The latch assembly 56 may form a portion of an interchangeable type trip unit assembly 20 as shown. For circuit breakers 22 with non-interchangeable type trip units 20, the latch assembly 56 is interlocked in a similar manner.

For illustration purposes, an interchangeable thermal magnetic trip unit is illustrated having both an adjustable magnetic unit and an adjustable thermal unit. A detailed description of such a thermal magnetic trip unit 58 is described in detail in U.S. Pat. Nos. 4,691,182 and 4,698,606, assigned to the same assignee as the assignee in the present invention and hereby incorporated by reference.

Figure 2:
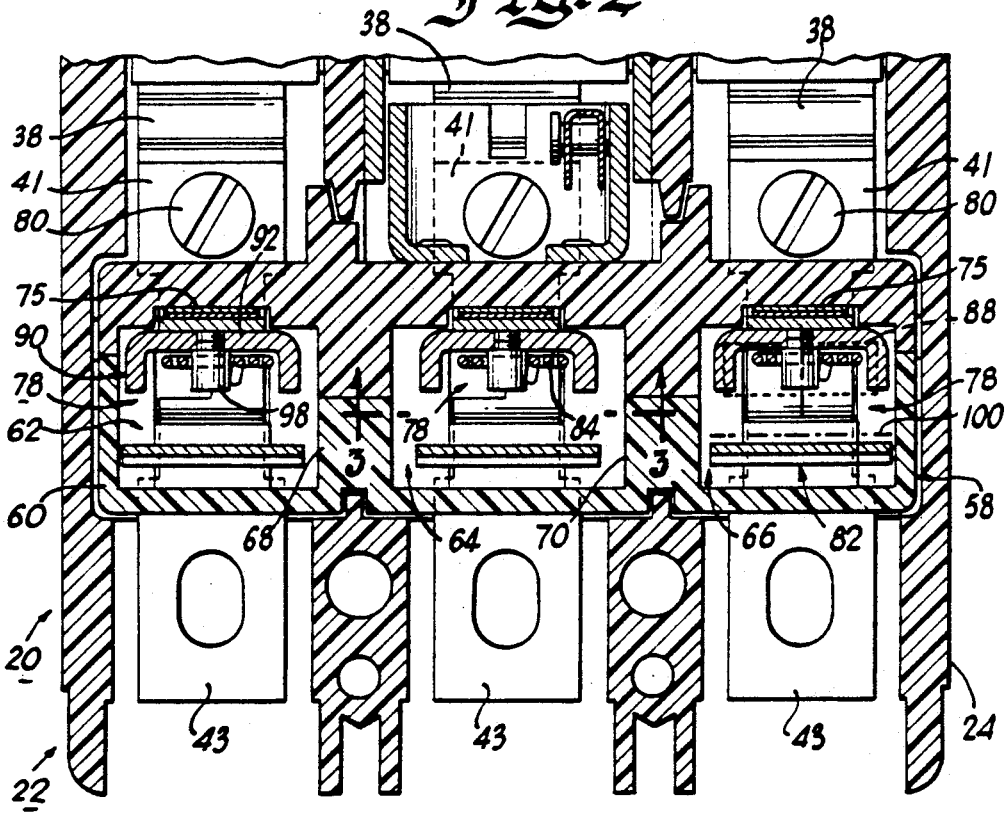
FIG. 2 is an enlarged plan sectional view taken along line 2—2 of FIG. 1.

These thermal magnetic trip units 20 are disposed in a separate housing 60 wherein each pole of the trip unit 20 is compartmentalized. For example, as shown in FIG. 2, a three pole thermal magnetic trip unit 20 is shown having compartments 62, 64 and 66; one compartment for each of the respective poles. Two interior sidewalls 68 and 70 are formed in the housing 60 to define the compartments 62, 64 and 66. A trip bar 72, common to all three compartments 62, 64 and 66, is journalled in the sidewalls 68 and 70. Operation of any pole of the thermal magnetic trip unit 58 will cause the trip bar 72 to rotate which, in turn, will release the latch assembly 56. Release of the latch assembly 56 causes the main contacts 28 to open under the influence of the operating spring 52.

The thermal magnetic trip unit 20 includes a thermal portion 74 including a bimetal 75 and a magnetic portion 76. The description of the thermal portion 74 is described in detail in U.S. Pat. Nos. 4,691,182 and 4,698,606. The magnetic portion 76 includes a multi-turn magnetic coil assembly 78 in accordance with the present invention, electrically connected to the load side conductor 38 and a line side conductor 39 by way of fasteners 80. The magnetic coil assembly is rigidly attached to the housing by way of fasteners 81.

An important aspect of the present invention is that the multi-turn magnetic coil assembly 78 occupies substantially the same volume as a single-turn magnetic coil disclosed in U.S. Pat. No. 4,691,182, assigned to the same assignee as the present invention and hereby incorporated by reference. Specifically, the multi-turn magnetic coil assembly 78 is used to increase the tripping force of anarmature assembly 82 within the magnetic trip unit 20 without increasing the volume requirements. By increasing the tripping force, the electrical current at which the magnetic unit 20 trips the circuit breaker 22 is greatly reduced. This allows the trip rating of the magnetic unit 20 to be reduced below the nominal 15 times the full load current to a lesser value without the need to utilize a relatively larger frame size or locate the thermal unit outside the circuit breaker 22.

Figures 3, 4, 5, 6, 7, 9:
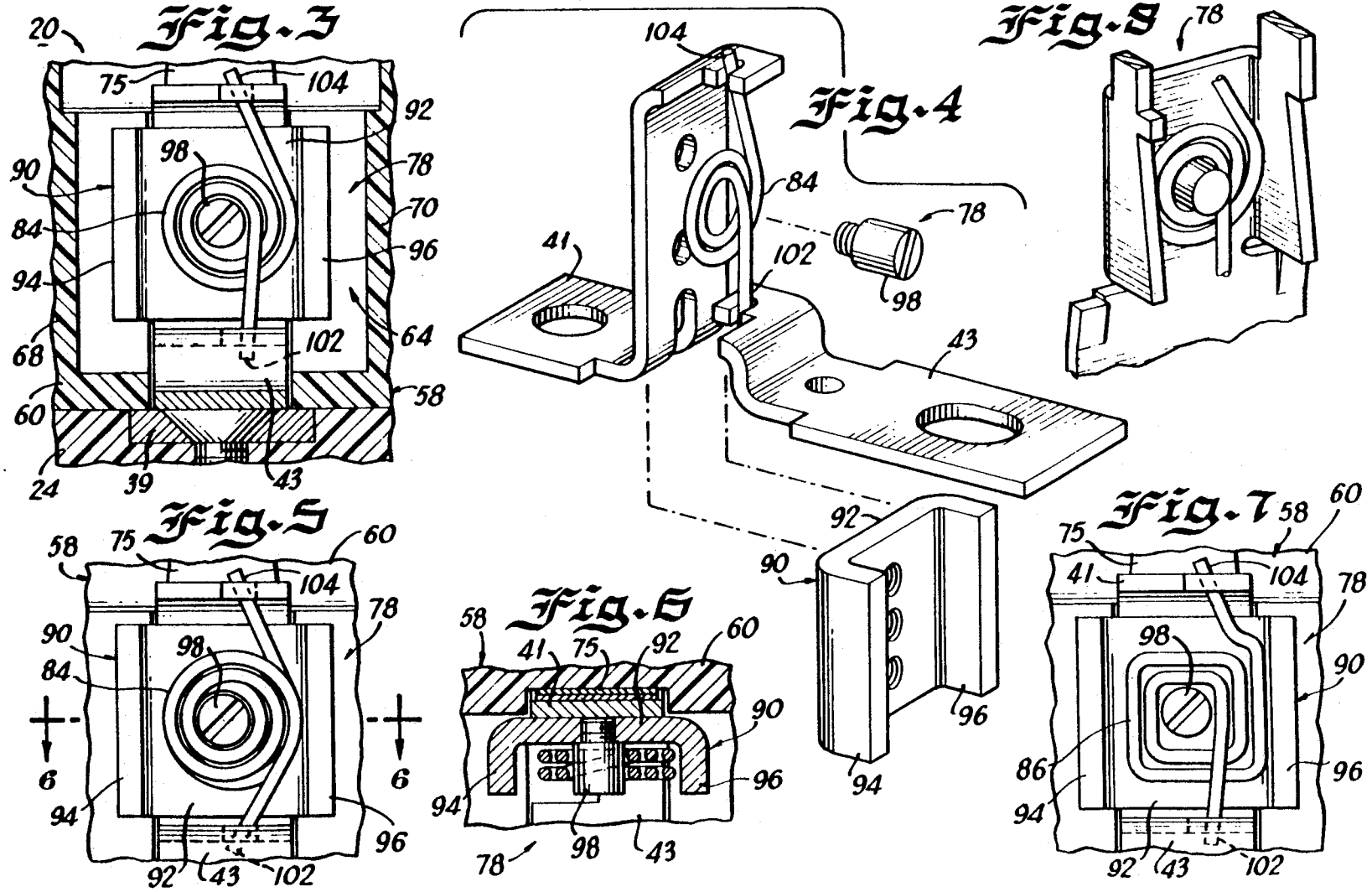
FIG. 3 is a further enlarged cross-sectional view taken along line 3—3 of FIG. 2.
FIG. 4 is an exploded perspective view of a portion of the present invention.
FIG. 5 is similar to FIG. 3 illustrating an alternate embodiment of the present invention.
FIG. 6 is a cross-sectional view taken along line 6—6 of FIG. 5.
FIG. 7 is similar to FIG. 3 illustrating another alternate embodiment of the present invention.

The multi-turn magnetic coil assembly 78 in accordance with the present invention may be formed from a circular cross-sectional electrical conductor or magnetic coil wire 84 as shown in FIG. 4 or a square or rectangular cross-sectional electrical conductor or magnetic coil wire 86 as shown in FIG. 7. Square or rectangular cross-sectional conductors 86 are generally used for relatively higher trip ratings than the circular cross-sectional area conductor. As shown, both embodiments of the multi-turn magnetic coil assembly 78 are shown to occupy the same volume, identified by the dashed box with the reference numeral 88, as shown in FIG. 2.

In one embodiment of the invention, as shown in FIGS. 1-4, an interchangeable type trip unit 20 is disclosed. In this embodiment, the magnetic coil assembly 78 consists of a magnetic core 90, formed in an E-shape as shown in FIG. 2. More specifically, the magnetic core 90 is formed from a metallic material defining a bight portion 92 and spaced apart depending legs 94 and 96. A center pin or leg 98 is disposed substantially perpendicular to the bight portion 92 forming an overall E-shape. The coil wire 84 is then wound in a single layer of overlapping turns around the center pin 98 as shown in FIGS. 3 and 4 forming a pancake design. The magnetic coil wire 84, is thus wound about an axis 99, substantially perpendicular with respect to a pivot axis 100 of the armature assembly 82.

The magnetic core 90 is preferably formed from a magnetic conducting material, such as a metallic material. Also, an important aspect of the invention is that the magnetic coil wire 84, 86 is disposed about the center pin 98 up to the height of the depending legs 94 and 96. The total volume thus occupied by the magnetic core 90 and magnetic coil forming the magnetic coil assembly 78 will thus be substantially the same volume as a single-turn magnetic coil.

It is also contemplated that the multi-turn magnetic coil assembly 78 can be utilized with both interchangeable and non-interchangeable type trip units. For example, as shown in FIG. 8, a non-interchangeable type trip unit is contemplated In this embodiment, the magnetic coil assembly 78 is disposed within the circuit breaker base 24. Otherwise it functions in a manner similar to an interchangeable type trip unit as discussed above.

In an alternate embodiment as illustrated in FIG. 7, a square or rectangular conductor 86 can be used for the magnetic coil wire and wound in either a spiral or a square or rectangular configuration. Similarly, the conductor 84 can also be wound in either a spiral or square or rectangular configuration.

Once the conductors 84 and 86 are disposed about the pin 98, the free ends 102 and 104 are serially connected to the load side conductor portion 43 and a line conductor portion 41. The free ends 102 and 104 of the magnetic coil wire 84, 86 may be attached to the conductor portions 41 and 43 by various means including welding, brazing, soldering, or the like.

In another alternate embodiment of the present invention, the multi-turn magnetic coil assembly 78 in accordance with the present invention, the magnetic coil wire 84 and 86 is disposed about the pin 98 and wound in a multiple layer as shown in FIGS. 5 and 6.

Obviously, many modifications and variations of the present invention are possible in light of the above teachings. Thus, it is understood that within the scope of the appended claims, the invention may be practiced otherwise than as specifically designated above.

What is claimed and desired to be secured by a Letters Patent of the United States is:

1. A molded case circuit breaker comprising:
a base;
a pair of separable main contacts disposed within said base;
an operating mechanism for opening and closing said pair of separable main contacts; and
a trip unit for actuating said operating mechanism including a magnetic trip unit having an armature assembly and a multi-turn magnetic oil assembly with single overlapping turns defining a pancake coil.

2. A molded case circuit breaker as recited in claim 1, wherein said trip unit is an interchangeable trip unit.

3. A molded case circuit breaker as recited in claim 1, wherein said trip unit is a non-interchangeable type trip unit.

4. A molded case circuit breaker as recited in claim 1, wherein said trip unit is a magnetic only trip unit.

5. A molded case circuit breaker as recited in claim 1, wherein said trip unit is a combination thermal magnetic unit.

6. A molded case circuit breaker as recited in claim 4, wherein said trip unit is adjustable.

7. A molded case circuit breaker as recited in claim 5, wherein said magnetic unit is adjustable.

8. A molded case circuit breaker as recited in claim 1, wherein said multi-turn magnetic coil assembly includes a magnetic core and a multi-turn coil.

9. A molded case circuit breaker as recited in claim 8, wherein said magnetic core includes a U-shaped member and a pin defining an E-shaped member.

10. A molded case circuit breaker as recited in claim 8, wherein said multi-turn coil is formed from an electrical conductor having a circular cross-section.

11. A molded case circuit breaker as recited in claim 8, wherein said multi-turn coil is formed from an electrical conductor having a rectangular cross-section

12. A molded case circuit breaker comprising:
a base;
a pair of separable main contacts disposed within said base;
an operating mechanism for opening and closing said pair of separable main contacts; and
a magnetic trip unit having an armature assembly disposed a predetermined air gap from a multi-turn magnetic wire assembly which includes a magnetic core having a multi-turn magnetic coil wound therearound with single overlapping turns defining a pancake coil.

13. A molded case circuit breaker as recited in claim 12, wherein said circuit breaker is a single pole circuit breaker.

14. A molded case circuit breaker as recited in claim 12, wherein said circuit breaker is a multiple pole circuit breaker.

15. A molded case circuit breaker comprising:
a base;
a pair of separable main contacts disposed within said base;
an operating mechanism for opening and closing said pair of separable main contacts; and
a magnetic trip unit having an armature assembly including an armature pivotally mounted about a predetermined axis disposed a predetermined air gap from a multi-turn magnetic coil assembly comprising a magnetic core and a multi-turn coil wound about a portion of said core substantially perpendicular to said predetermined axis with single overlapping turns defining a pancake coil.

16. A molded case circuit breaker as recited in claim 15 wherein said magnetic core is formed as an E-shaped member defining two outer legs and a center leg.

17. A molded case circuit breaker as recited in claim 16, wherein said magnetic coil is wound around said center leg.

18. A molded case circuit breaker as recited in claim 15 wherein said multi-turn magnetic coil is formed from an electrical conductor having a circular cross-section.

19. A molded case circuit breaker as recited in claim 15, wherein said multi-turn magnetic coil is formed from an electrical conductor having a rectangular cross-section.

20. A molded case circuit breaker comprising:
a base;
a pair of separable main contacts disposed within said
an operating mechanism for opening and closing said pair of separable main contacts; and
a trip unit for actuating said operating mechanism including a magnetic trip unit having an armature assembly and a multi-turn magnetic oil assembly, wherein said multi-turn magnetic coil assembly includes a magnetic core and a multi-turn coil, wherein said magnetic core includes a U-shaped member and a pin defining an E-shaped member, wherein said multi-turn coil is wound around said pin with a single layer of overlapping turns defining a pancake.

* * * * *